US005572298A

United States Patent [19]

Nagahara et al.

[11] Patent Number: 5,572,298

[45] Date of Patent: Nov. 5, 1996

[54] IMAGE FORMING APPARATUS HAVING A DEVELOPING APPARATUS WHICH INCLUDES A PARTITION MEMBER FOR PARTITIONING A DEVELOPING ROOM AND A TONER HOPPER

[75] Inventors: Akira Nagahara; Sachio Sasaki; Mitsuru Sato; Shigenobu Utaka, all of Kawasaki; Takefumi Takahashi, Inagi; Masahiro Wanou; Masao Konishi, both of Kawasaki, all of Japan

[73] Assignee: Fujitsu Limited, Kawasaki, Japan

[21] Appl. No.: 400,561

[22] Filed: Mar. 8, 1995

Related U.S. Application Data

[62] Division of Ser. No. 220,096, Mar. 30, 1994.

[30] Foreign Application Priority Data

Mar. 31, 1993 [JP] Japan ..... 5-098573

[51] Int. Cl.[6] ..... G03G 15/09

[52] U.S. Cl. ..... 399/107

[58] Field of Search ..... 355/251, 253, 355/245; 118/657, 658

[56] References Cited

U.S. PATENT DOCUMENTS

| | | | |
|---|---|---|---|
| 4,320,958 | 3/1982 | Fantuzzo | 355/270 |
| 4,676,192 | 6/1987 | Yugo . | |
| 5,134,441 | 7/1992 | Nagata et al. | 355/245 |
| 5,188,057 | 2/1993 | Ishikawa et al. | 118/657 |
| 5,307,126 | 4/1994 | Kurita | 355/251 |
| 5,387,964 | 2/1995 | Kanno et al. | 355/251 |

*Primary Examiner*—R. L. Moses

*Attorney, Agent, or Firm*—Armstrong, Westerman, Hattori, McLeland & Naughton

[57] ABSTRACT

Disclosed is an image forming apparatus capable of performing an image forming operation in both a horizontal position and an upright position. This image forming apparatus comprises a rotary endless latent image carrier; image forming unit for forming an electrostatic latent image on the latent image carrier; developing unit for developing the electrostatic latent image on the latent image carrier with a powdery developer, the developing unit having a developing room, developing rollers provided in the developing room for supplying the powdery developer to the latent image carrier, a toner supply room for supplying toners, toner supply roller provided in the toner supply room and rotatable to supply the toners to the developing room, and a partition member for partitioning the developing room and the toner supply room and forming a toner supply passage for supplying the toners to the developing room; and transfer unit for transferring the developed image on the latent image carrier to a sheet.

20 Claims, 10 Drawing Sheets

IMAGE FORMING APPARATUS HAVING A DEVELOPING APPARATUS WHICH INCLUDES A PARTITION MEMBER FOR PARTITIONING A DEVELOPING ROOM AND A TONER HOPPER

This is a division of application Ser. No. 08/220,096 filed Mar. 30, 1994.

BACKGROUND OF THE INVENTION

1. Field of the Invention

The present invention relates to an image forming apparatus which, in a horizontal or upright position, will develop an electrostatic latent image on a latent image carrier with a powdery developer.

2. Description of the Related Art

In image recording apparatuses, such as a copying machine, a printer and a facsimile, a latent image forming apparatus like an electrophotographic apparatus is used due to the popularity of image recording on normal sheets of paper.

Such an image forming apparatus forms an electrostatic latent image on a photosensitive drum or the like. Then, the electrostatic latent image on the photosensitive drum is developed with a powder developer to provide a visible image. The developed image on the photosensitive drum is then transferred on a sheet, and the sheet is then separated from the photosensitive drum. Thereafter, the developed image on the sheet is fixed.

In view of the recent office environment, it is desirable that the image forming apparatus be sited in any position. That is, the image forming apparatus should be designed to allow a user to freely select the way the apparatus is sited, upright siting for narrower site space or horizontal siting for shorter site space.

FIGS. 10A and 10B arc explanatory diagrams of prior arts.

Such an image forming apparatus will be described below as an electrophotographic printer. As shown in FIG. 10A, a precharger 91 uniformly charges the surface of a photosensitive drum 90, and an exposing unit 92 exposes the photosensitive drum 90 to a light image to form an electrostatic latent image thereon. A developing unit 93 is provided to develop the electrostatic latent image on the photosensitive drum 90. This developing unit 93 supplies a powder developer (e.g., one-component magnetic toners or a two-component developer) to the photosensitive drum 90 to develop the electrostatic latent image.

The developed image on the photosensitive drum 90 is transferred on a sheet that has been fed out from a sheet cassette 98. The sheet carrying the transferred image is fed to a fixing unit 96 where the developed image is fixed on the sheet. The photosensitive drum after image transfer is cleaned with a cleaner 95.

The powdery developer in the developing unit 93 has fluidity in the direction of gravity, so that gravity is a dominant factor in supplying the powdery developer. The image forming apparatus shown in FIG. 10A, which functions in a horizontal position, will carry out a stable developing operation in the horizontal position.

This type of image forming apparatus may be provided with a handle 97 as shown in FIG. 10A so that a user can carry and place it upright for storage. Such an image forming apparatus has been proposed in Japanese Unexamined Patent Publication No. 130345/1983 and Japanese Unexamined Utility Model Publication No. 184061/1985, for example. This image forming apparatus is so designed as to prevent the developer from falling off the developing unit 93 when the apparatus is placed upright, and this apparatus cannot function in that upright position.

There has been proposed an image forming apparatus which can operate in an upright position in order to reduce the space it should occupy, as shown in FIG. 10B (sec Japanese Unexamined Patent Publication No. 4-84176, for example.). In this type, a developing unit 93 for developing an electrostatic latent image on a photosensitive belt 90 will properly function in an upright position, but will not carry out a stable developing operation in a horizontal position.

Due to the recent popularity of image forming apparatuses, there is a demand that the apparatuses should function in any position desired by the users. For example, while the image forming apparatuses in a horizontal position would be stable and require shorter site space, the apparatuses in an upright position would require narrower site space to ensure effective use of the space on a desk or the like. This demand cannot be fulfilled by the conventional apparatuses which could function in either a horizontal position or an upright position.

If the apparatus shown in FIG. 10A is placed upright, the developer would come off of the developing unit, disabling the supply of the developer. If the apparatus shown in FIG. 10B is used in a horizontal position, the supply amount of the developer would vary, thus changing the image density.

SUMMARY OF THE INVENTION

It is therefore a primary object of the present invention to provide an image forming apparatus which will accomplish a stable image forming operation in both a horizontal position and an upright position.

It is another object of the present invention to provide an image forming apparatus which will ensure a stable and uniform developing density in both a horizontal position and an upright position.

To achieve the foregoing and other objects in accordance with the purpose of the present invention, according to one aspect of the invention, an image forming apparatus capable of performing an image forming operation in both a horizontal position and an upright position, comprises a rotary endless latent image carrier; image forming means for forming an electrostatic latent image on the latent image carrier; developing means for developing the electrostatic latent image on the latent image carrier with a powdery developer, the developing means having a developing room, developing roller, provided in said developing room, for supplying the powdery developer to the latent image carrier, a toner supply room for supplying toners, toner supply means provided in the toner supply room and rotatable to supply the toners to the developing room, and a partition member for partitioning the developing room and the toner supply room and forming a toner supply passage for supplying the toners to the developing room; and transfer means for transferring the developed image on the latent image carrier to a sheet.

According to the present invention, the developing unit is separated into the developing room and the toner supply room, which are connected by the toner supply passage. This structure itself has already been employed in a 1.5-component developing unit (e.g., Japanese Unexamined Patent Publication No. 252686/1991). But, the present invention further has the rotatable toner supply means in the toner supply room. Furthermore, the partition member is provided to separate the developing room from the toner supply room so that only the toners supplied by this toner supply means will be supplied via the toner supply passage to the developing room. Accordingly, the toners supplied to the developing room are mostly what is supplied by toner supply means. This accomplishes the toner supply that is not affected by the fluidity of the toners in the direction of gravity. Even if the siting position of the image forming apparatus changes, therefore, the amount of toner supply does not change, thus ensuring a stable developing operation.

Other features and advantages of the present invention will become readily apparent from the following description taken in conjunction with the accompanying drawings.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiments given below, serve to explain the principles of the invention.

DETAILED DESCRIPTION OF THE PREFERRED EMBODIMENT

Figure 1:
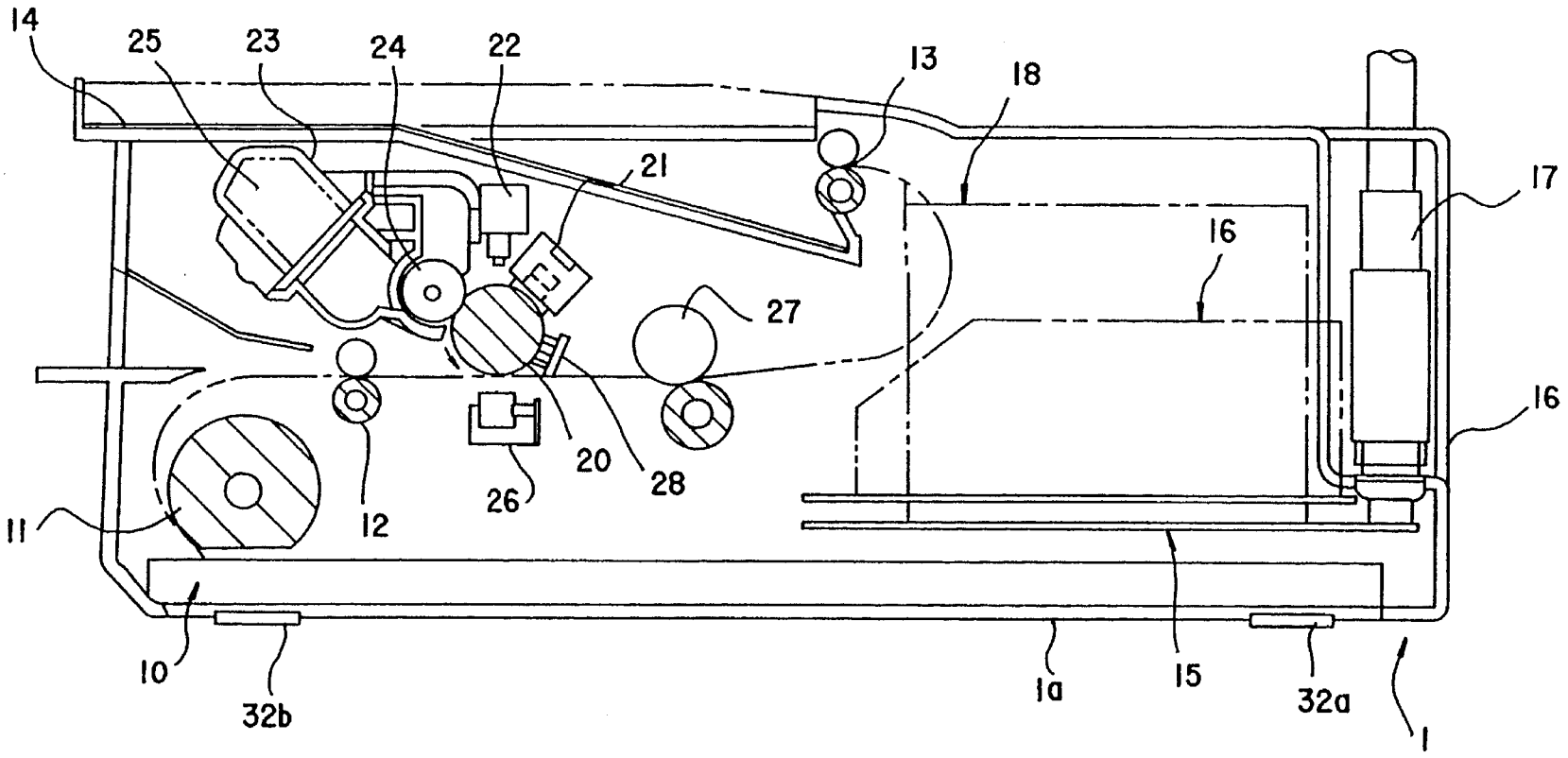
FIG. 1 is a structural diagram of a printer according to one embodiment of the present invention.
Figure 2:
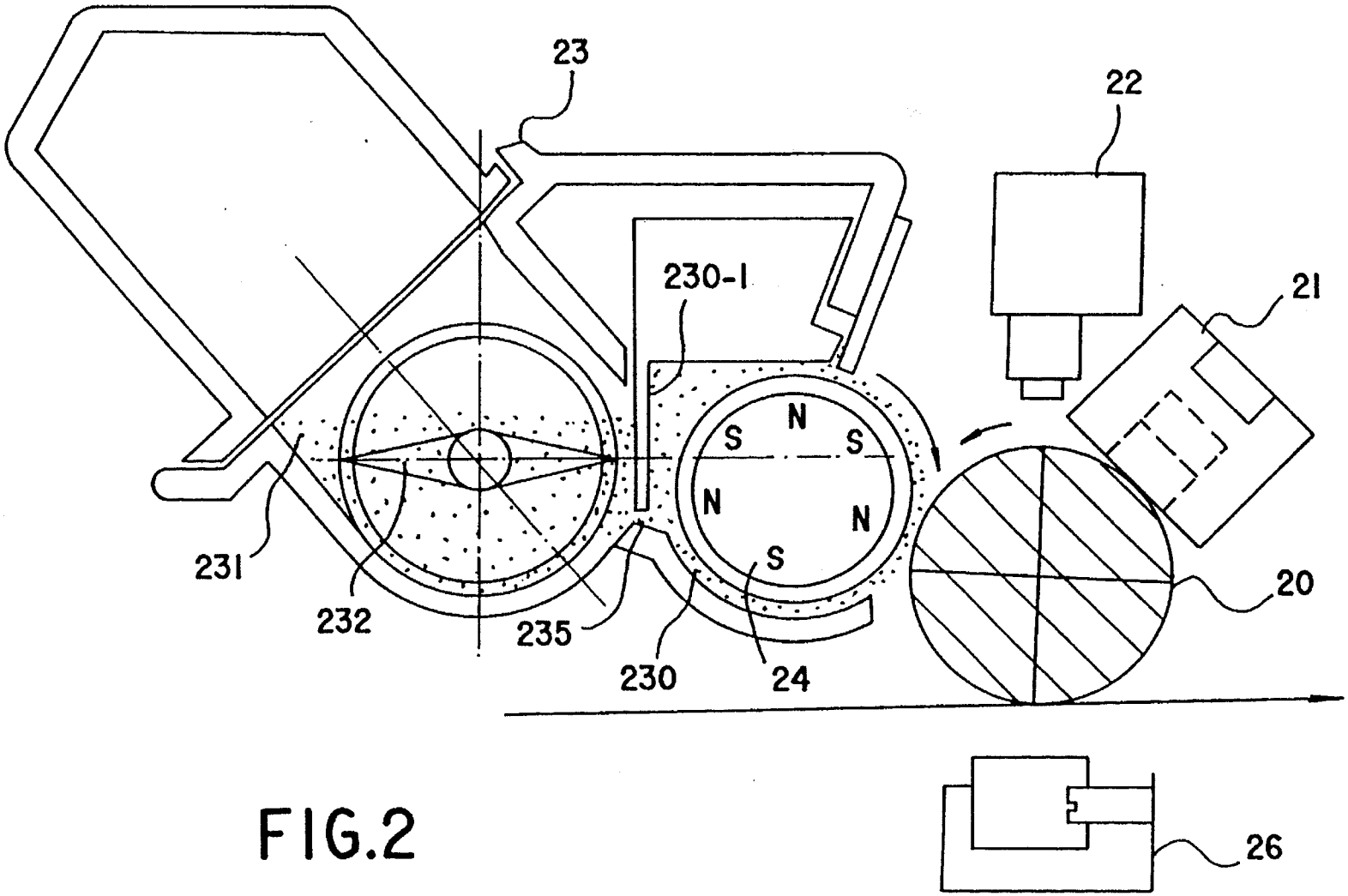
FIG. 2 is a structural diagram of a printing process unit having the structure shown in FIG. 1.
Figure 3:
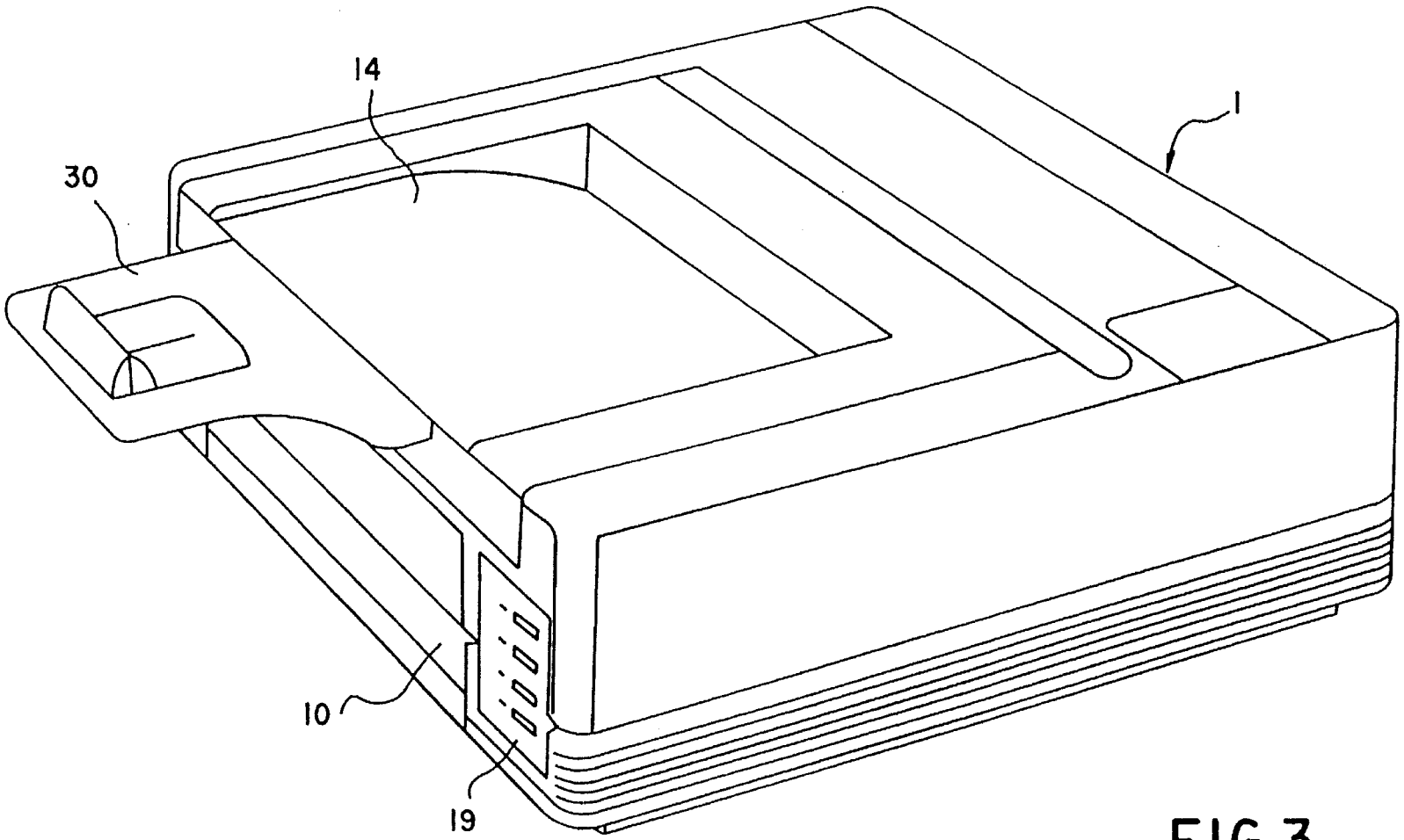
FIG. 3 is a diagram showing the printer in FIG. 1 in a horizontal position.
Figure 4:
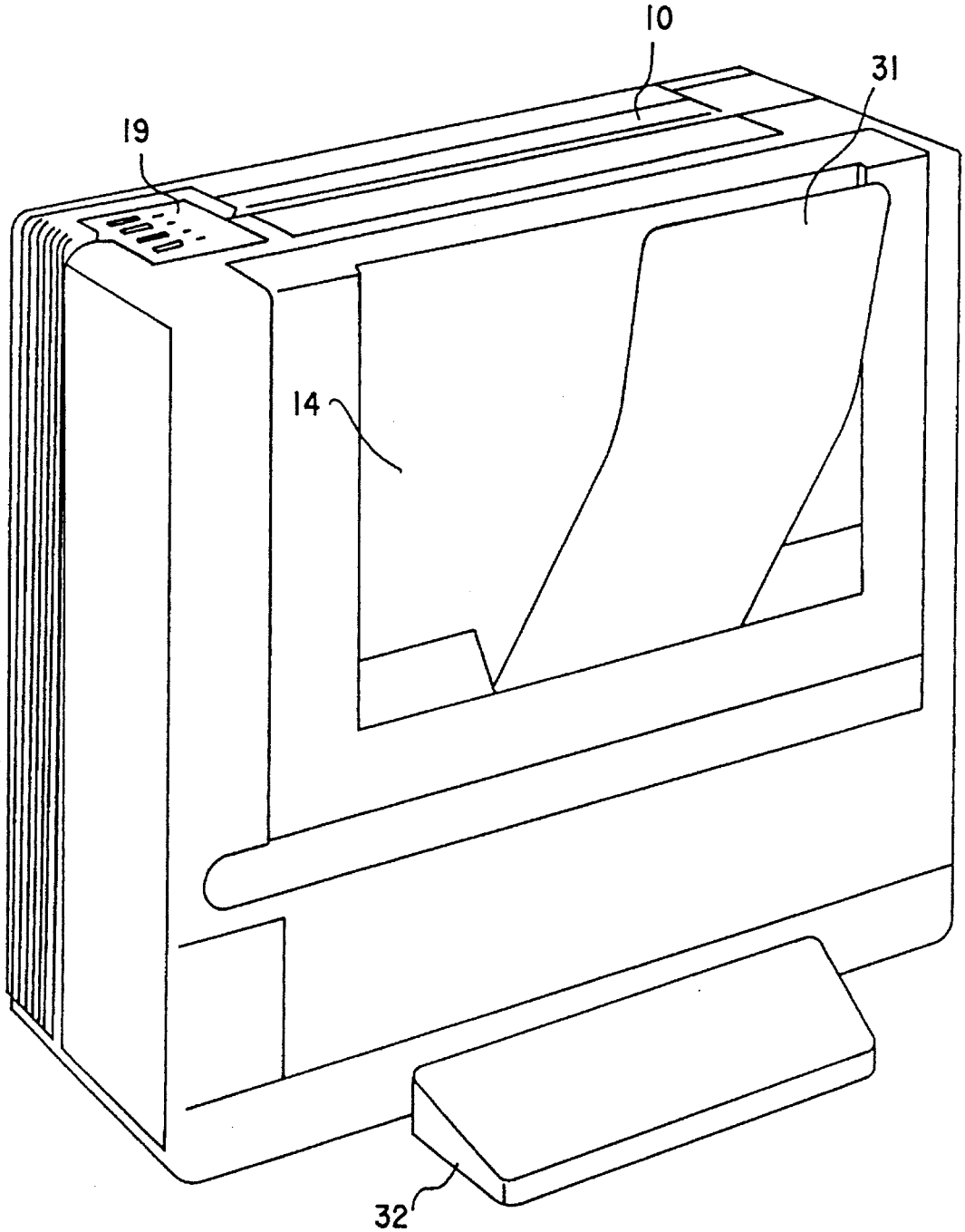
FIG. 4 is a diagram showing the printer in FIG. 1 in an upright position.

FIG. 1 is a structural diagram of a printer according to one embodiment of the present invention; FIG. 2 is a structural diagram of a printing process unit having the structure shown in FIG. 1; FIG. 3 is a diagram showing the printer in FIG. 1 in a horizontal position; and FIG. 4 is a diagram showing the printer in FIG. 1 in an upright position. FIGS. 1 and 2 show a cleanerless electrophotographing printer.

Referring to FIGS. 1 and 2, a photosensitive drum 20 is an aluminum drum on which a functionally separate organic photosensitive body is coated about 20 microns thick. This photosensitive drum 1 has an outside diameter of 24 mm and rotates at a peripheral speed of 25 mm/s in the counterclockwise direction indicated by the arrow. A precharger 21 uniformly charges the surface of the photosensitive drum 20 and is a non-contact type charger constituted of a Scolotron. This precharger 21 charges the surface of the photosensitive drum 20 with −600 V.

An optical unit 22 exposes the photosensitive drum 20 to image light to form an electrostatic latent image. This optical unit 22 in use is an LED optical system which has an LED array combined with a self-focus array. This optical unit 22 exposes the photosensitive drum 20 to image light in accordance with an image pattern to form an electrostatic latent image. The potential of the latent image portion becomes −50 to −100 V.

A developing unit 23 supplies charged toners to the electrostatic latent image on the photosensitive drum 20 to provide a visible toner image. This developing unit 23 will be discussed later with reference to FIG. 5. Developing rollers 24 feed a developer to the photosensitive drum 20. A toner cartridge 25 supplies magnetic toners to the developing unit 23 and is exchangeable in an toner empty status.

A transfer unit 26 is constituted of a corona discharger. This transfer unit 26 electrostatically transfers the toner image on the photosensitive drum 20, onto a sheet. The operational principle is to apply a voltage of +3 kV to +10 kV to a corona wire from a power supply so that electric charges will be generated by corona discharging. The back of the sheet is charged with the electric charges so that the toner image on the photosensitive drum 20 is transferred on the sheet P. It is desirable that this power supply be a constant current source which supplies a constant amount of charges to the sheet to thereby reduce the deterioration of the transfer efficiency due to the environmental conditions.

A fixing unit 27 thermally fixes the toner image on the sheet. This fixing unit 27 comprises a heat roller having a halogen lamp incorporated therein as a heat source, and heat rollers (backup rollers), and heats the sheet to fix the toner image on the sheet.

A uniform distribution brush 28 is a conductive brush, which, when in contact with the photosensitive drum 20, prevents the concentration of residual toners on the photosensitive drum 20 and uniformly distributes them over the drum 20 to facilitate the toner collection in the developing unit 23.

An AC voltage is applied to this uniform distribution brush 28 to remove the residual toners off the photosensitive drum 20 and place the toners again on the drum 20 to properly distribute the residual toners. This scheme will also prevent filming of the toners. Further, a voltage equal to or greater than the voltage needed to start discharging may be applied to the brush 28 to de-electrify the photosensitive drum 20, in which case a residual positive image formed by the residual charges will be eliminated.

A sheet cassette 10, which retains sheets, is detachably attached to the printer. This sheet cassette 10 is installed at the lower portion of the printer and can be attached to or detached from the printer from the front side of the printer, which is on the left-hand side in FIG. 1. Pickup rollers 11 serve to pick up sheets from the sheet cassette 10. Resist rollers 12 align the leading edge of a picked sheet when it abuts on the rollers 12 before feeding the sheet to the transfer unit 26. Discharge rollers 13 discharge the sheet after image fixing onto a stacker 14. The stacker 14 is provided on the top of the printer to receive the discharged sheet.

A printed circuit board 15 has a printer controller installed thereon. A power supply 16 supplies power to the individual sections of the printer. An interface connector 17 is connected to an external cable at one end and is inserted in the printer at the other end to be connected to the connector of the printed circuit board 15. An optional board 18 has another type of emulator circuit, font memory, etc. installed thereon.

The operation of this embodiment will be described below. After the surface of the photosensitive drum 20 is evenly charged to −600 V by the Scolotron charger 21, image exposure is performed by the LED optical system 22 to form an electrostatic latent image with the background portion charged to −600 V and the exposed or printing portion charged to −50 to −100 V, on the photosensitive drum 20.

A developing bias voltage (−450 V) is applied to the sleeves of the developing roller 24 of the developing unit 23. Therefore, the electrostatic latent image is developed by polymerization toners, which have previously been stirred with a carrier to have been charged negatively, in the developing unit 23, yielding a toner image.

Mean while, a sheet is picked up from the sheet cassette 10 by the pickup rollers 11 and its leading edge is aligned by the resist rollers 12 before being sent to the transfer unit 26. The toner image on the photosensitive drum 20 is transferred onto the sheet by electrostatic force by the transfer unit 26. The toner image on the sheet is fixed by the fixing unit 27, and is fed along an U-shaped feeding path to be discharged on the stacker 14 by the discharge rollers 13.

After the image transfer, the distribution brush 28 distributes the residual toners on the photosensitive drum 20 and removes the residual charges. The residual toners on the drum 20 pass through the Scolotron charger 21 and LED optical system 22 to reach the developing unit 23 and are collected by the developing roller 24 at the same time as the next developing process starts. The collected toners will be used again in the developing unit 23.

In the cleanerless process, (1) no mechanism for disposing toners is required, thus contributing to making the printer compact, (2) no space required to store the disposed toners, (3) all the toners will be used in printing, which is economical, (4) no toners will be disposed of, which is friendly to the environmental preservation, (5) no cleaner, which scrapes the surface the photosensitive drum 20 to shorten the service life thereof, is used to thereby elongate the life of the drum 20.

In the recording process, the residual toners on the photosensitive drum 20 after image transfer are distributed by the uniform distribution brush 28. Thereafter, the surface of the photosensitive drum 20 with toners sticking thereon is evenly charged by the corona charger 21, image exposure is performed by the LED optical system 22 and image developing is conducted at the same time as the collection of the residual toners after image transfer by the developing unit 23.

The uniform distribution brush 28 distributes the toners concentrating locally to reduce the amount of toners per unit area, so that the toner collection by the developing unit 23 becomes easier. As an additional advantage, the brush 28 suppresses the effect of the toner's ion shower of the corona charger 21 by the toners and the filtering effect by the toners in the image exposing process.

The key point of this recording process is to collect the toners on the photosensitive drum 20 at the same time as the developing process is carried out. This will be further discussed below with reference to the case where the photosensitive drum 20 and the toners are both charged negatively. The surface potential of the photosensitive drum 20 is set to −500 to −1000 V by the charger 21. The exposed portion whose potential has dropped by image exposure will have a reduced potential of 0 to minus several tens of volts, forming an electrostatic latent image. At the time of image developing, a developing bias voltage (e.g., −300 V), which is an almost middle of the surface potential and the potential of the latent image, is applied to the developing roller 24 of the developing unit 23.

In the developing process, the negatively charged toners sticking on the developing roller 24 are adhered to the electrostatic latent image on the photosensitive drum 20, forming a toner image, by an electric field that is created by the developing bias voltage and the potential of the latent image. In the cleanerless process, the residual toners after image transfer which have been distributed over the photosensitive drum 20 in the uniform distribution process by the distribution brush 28 are collected from the photosensitive drum 20 by the developing rollers 24 by the electric field, generated by the surface potential and latent image potential, the electrostatic force and magnetic force.

Because of no cleaner used and other reasons, this printer will be designed very compact; the printer in FIG. 1 is 350 mm long including the length of the sheet cassette 10, 345 mm wide and 130 mm tall. This printer will be easily placed on the top of a desk as a personal-usage printer.

Further, this printer can be placed in a horizontal position with the sheet cassette 10 extending in parallel to a siting surface, as shown in FIG. 3. In this diagram, an operation panel 19 is provided on the front face of the printer to indicate the operation of the printer. A sheet guide 30 is provided at the distal end of the stacker 14. This sheet guide 30 serves to press and align the leading edge the sheet that is to be discharged on the stacker 14.

In this embodiment, the sheet cassette 10 can be attached to and detached from the front side of the printer and the operation panel 19 is operable also from the front side. In addition, the sheet is discharged to the front of the printer.

When the printer is being used in the horizontal position, four rubber stands **32*a* and 32*b*, each of which is proveded at each corner of a bottom surface 1*a* of the printer, are used and function as a stand member. The bottom surface 1*a*** of the printer is the sitting surface when the printer is used in the horizontal position.

Further, image formation is possible in an upright position where the interface connector 17 of the printer in FIG. 1 is provided on a siting surface **1*b*, and the sheet cassette 10 is set upright to be perpendicular to the siting surface 1*b*. The sitting surface 1*b* is a rear surface of the printer 1. This reduces the siting space further. Under this condition, the developing unit 23 is located above the photosensitive drum 20. At this time, a sheet presser 31 may be provided on the stacker 14 to press sheets to be discharged on the stacker so that the sheets will not fall down even when the printer is placed upright. If a stand 32 is provided at the siting surface 1*b* of the printer as illustrated in FIG. 4**, the printer even in an upright position stay stably.

As a stand provided at the sitting surface **1*b*, rubber stands which are fixed at each corner of the sitting surface 1*b*** of the printer, may be used.

Further, the bottom surface and the rear surface themselves may be used as a stand member.

Even without the cleanerless process, as the precharger 21 and the transfer unit 26 are constituted of a non-contact type discharger, the toners on the photosensitive drum 20 will not stick on those units, so that the uniform charging and image transfer can be accomplished stably.

Figure 5:
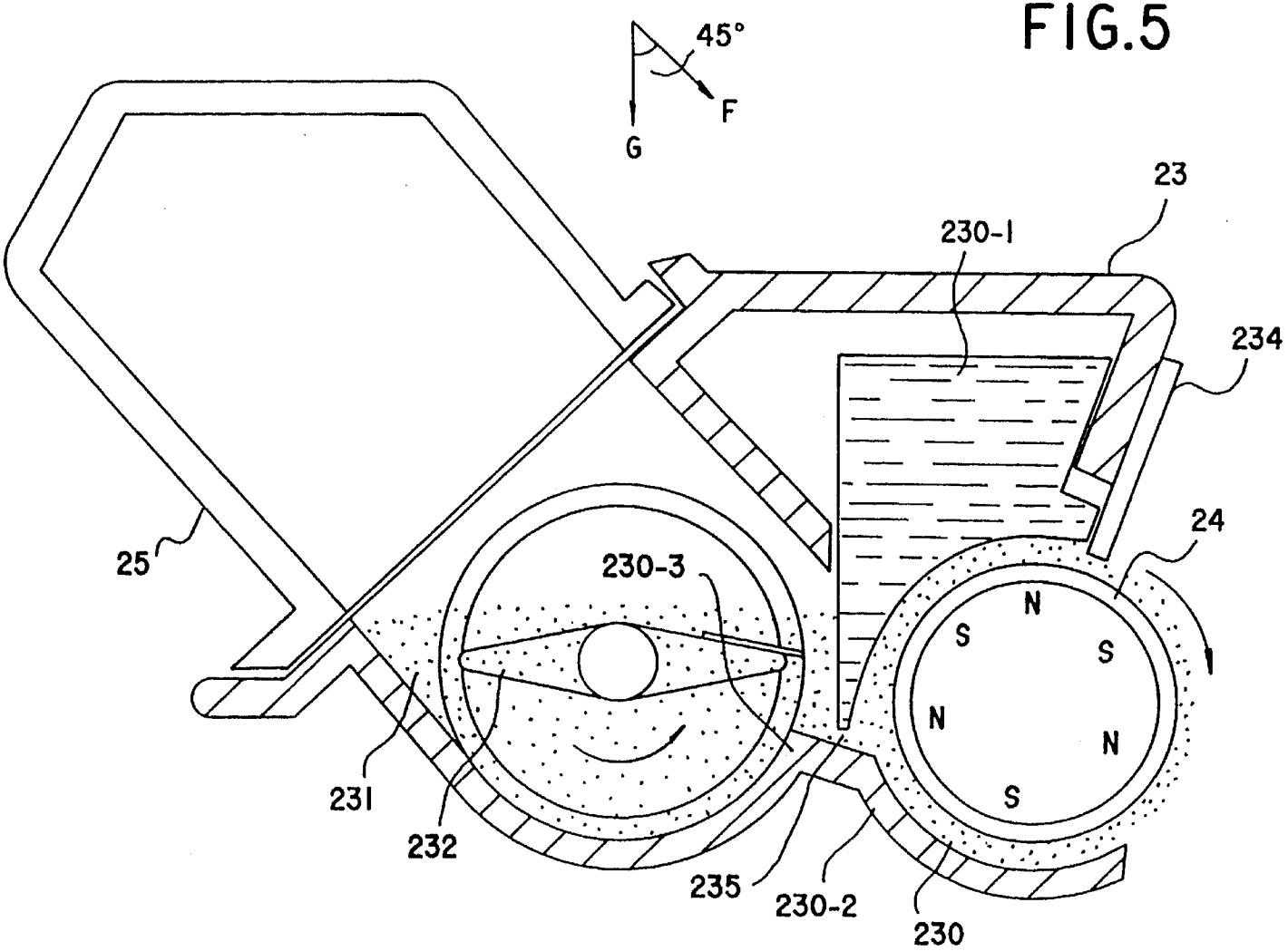
FIG. 5 is a structural diagram of a developing unit in the structure in FIG. 2.
Figure 6:
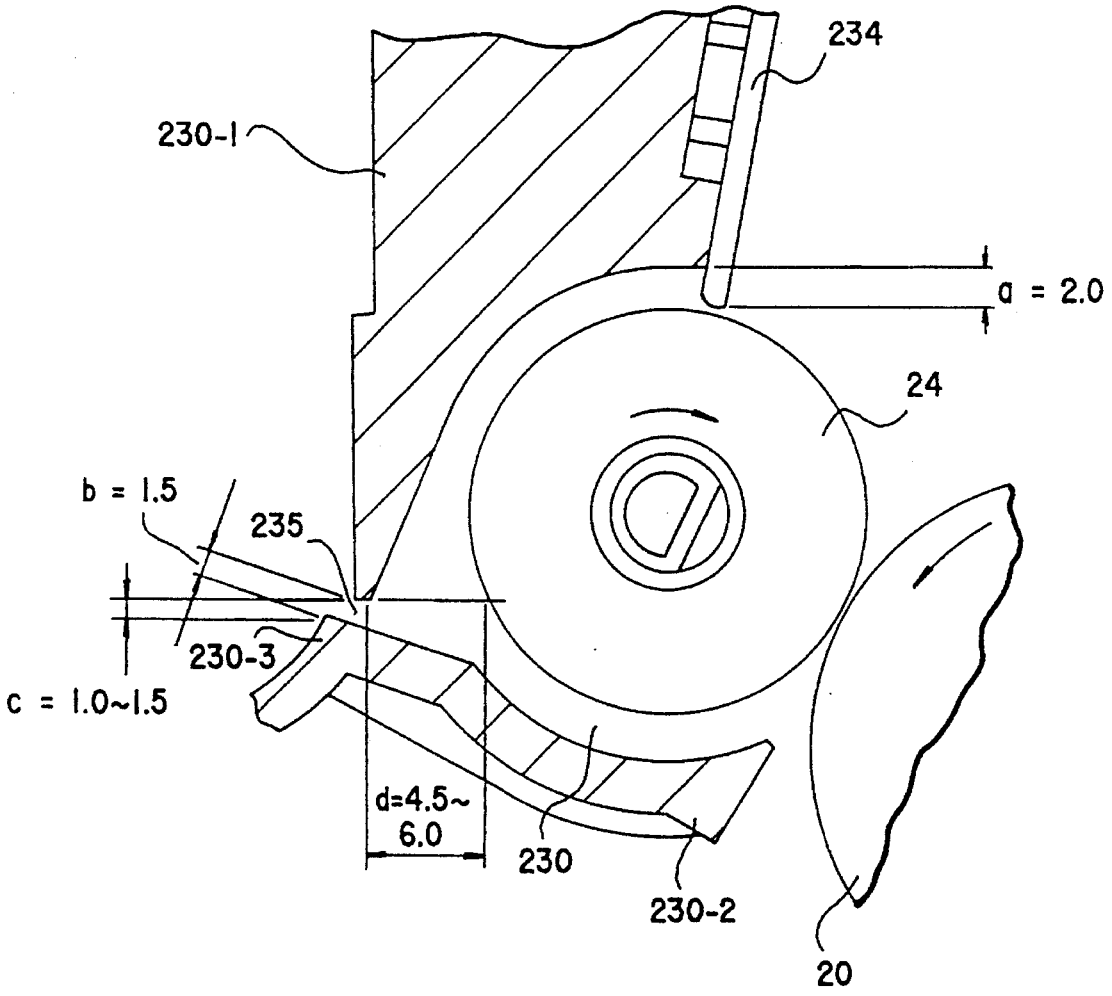
FIG. 6 is a cross section showing the essential portions of the developing unit in FIG. 5.
Figure 7:
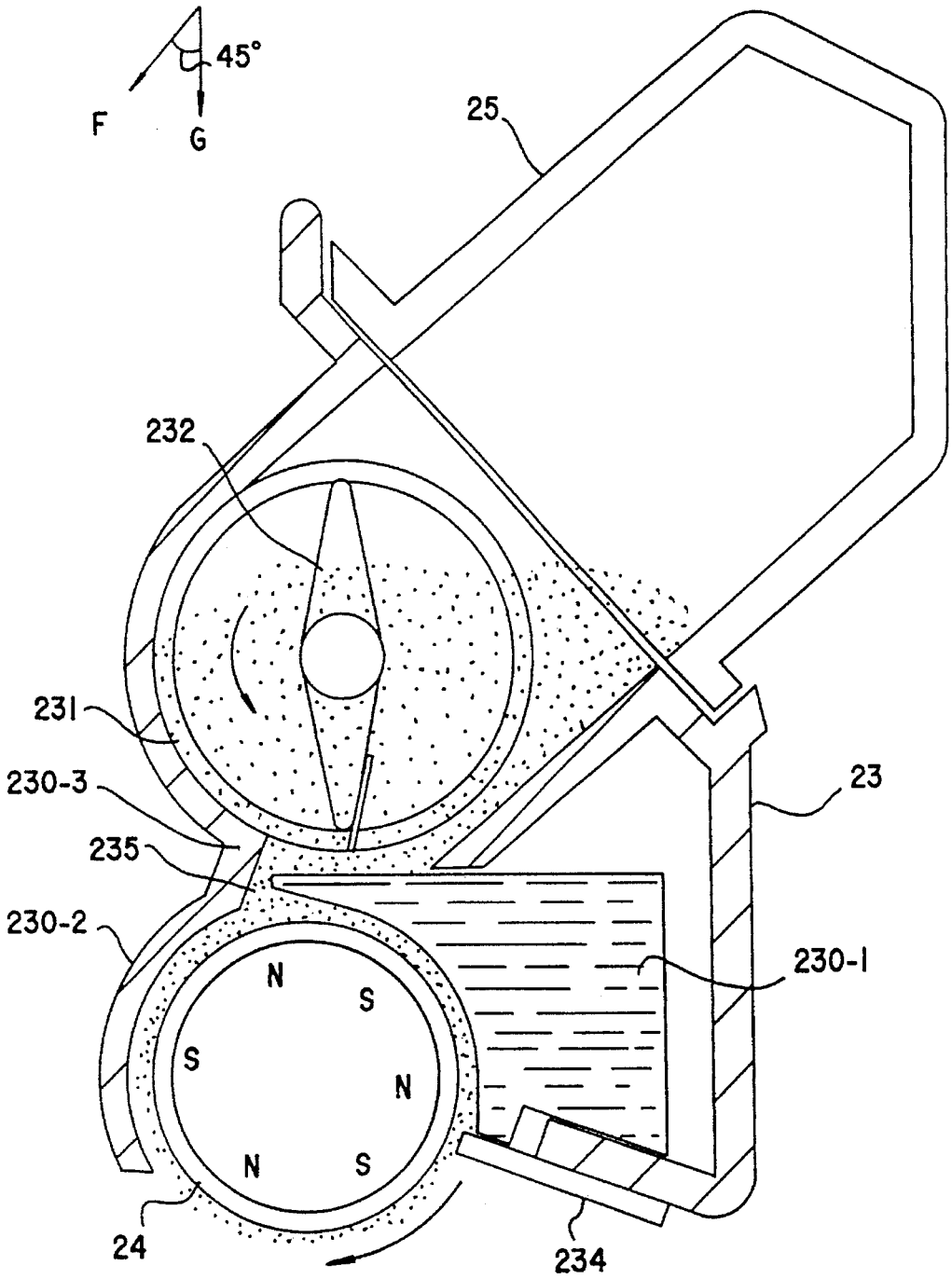
FIG. 7 is a diagram showing the developing unit in FIG. 5 in an upright position.
Figure 8A:
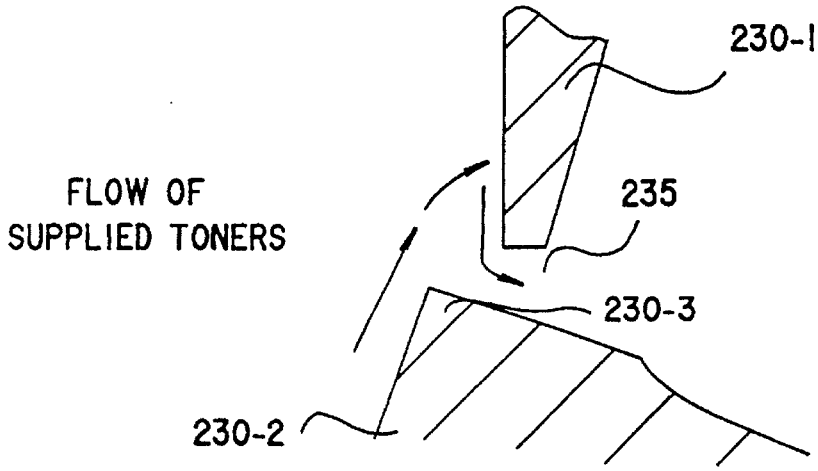
FIGS. 8A and 8B are diagrams for explaining the operation of the developing unit according to the present invention.
Figure 8B:
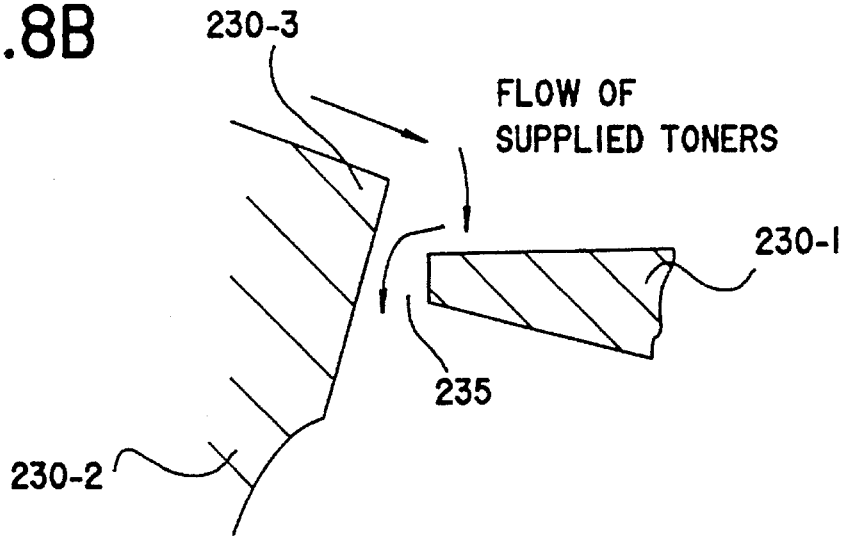
Figure 9:
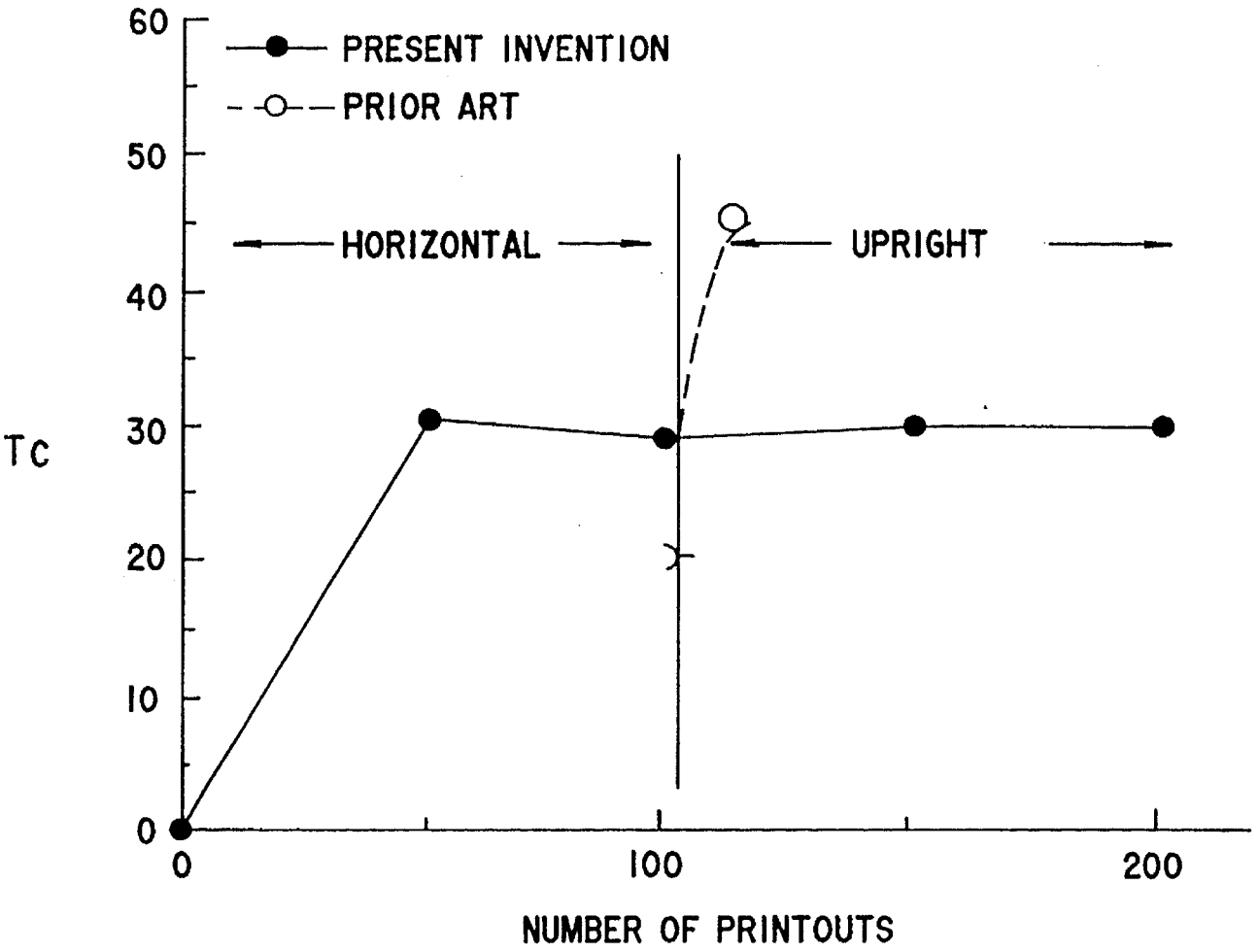
FIG. 9 is a characteristic chart of the image forming operation of the present invention.
Figure 10A:
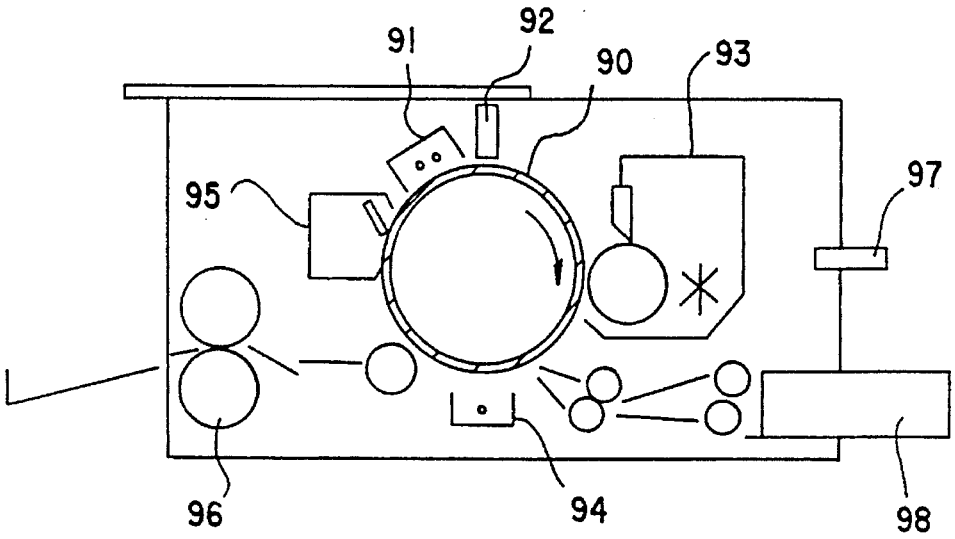
FIG.10A PRIOR ART
FIGS. 10A and 10B are explanatory diagrams of prior arts.
Figure 10B:
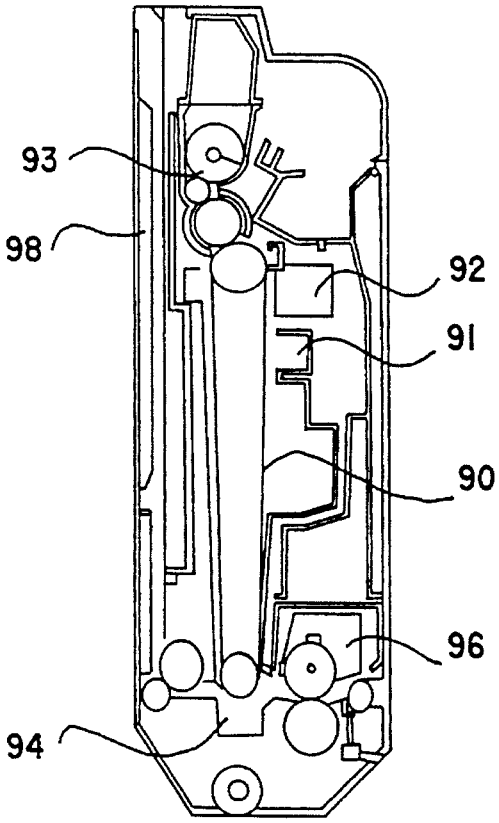
FIG.10B PRIOR ART

FIG. 5 is a structural diagram of the developing unit in FIG. 2, FIG. 6 is a cross section showing the essential portions of the developing unit in FIG. 5, FIG. 7 is a diagram showing the developing unit in FIG. 5 in an upright position, FIGS. 8A and 8B are diagrams for explaining the toner supply operation, and FIG. 9 is a characteristic chart of the image forming operation of the present invention.

In FIG. 5, the developing roller 24 is comprised of a metal sleeve and a plurality of magnetic poles which are disposed inside the metal sleeve. The developing rollers 24 feed a magnetic developer (to be described later) by the rotation of the sleeve, with the magnet rollers inside the sleeve secured. The developing rollers 4 are 16 mm in diameter and rotate at a speed (75 mm/s) three times faster than the peripheral speed of the photosensitive drum 20.

A developing room 230 is formed around the developing roller 24. The developing room 230 is filled with a 1.5-component developer, which is a mixture of a magnetic carrier and magnetic toners. This developing room 230 is defined by an upper partition member 230-1 and a bottom 230-2, and has a constant volume.

When a constant amount of a magnetic carrier is supplied to the developing room 230, the amount of the magnetic toners in this room 230 also becomes constant. As the amount of the developer in the developing room 230 is constant, the toner density becomes constant when the used magnetic toners are supplemented from a toner hopper 231. This can eliminate the need to control the toner density. In other words, the toner density is automatically controlled within a predetermined range by supplementing the amount of the magnetic carrier, which is equivalent to the control point for the toner density, into the developing room 230.

Because the developer is always fully present around the developing roller 24 in this developing room 230, even with the printer placed upright, the developer in the developing room 230 will not concentrate at some part, thus preventing insufficient supply of the developer to the developing roller 24. The magnetic carrier in the developer is a magnetite carrier of an average particle size of 40 microns.

The magnetic toners are polymerized toners of an average particle size of 7 microns. The polymerization toners have a uniform particle size and have a sharp particle distribution, so that adhesion between the sheet and the toner image on the photosensitive drum 20 becomes uniform in the transfer process. Accordingly, the electric field in the transfer section becomes uniform, thus improving the transfer efficiency more than the conventional pulverizing method. The transfer efficiency of the pulverized toners is 60 to 90% while the transfer efficient of the polymerization toners is 90% or above.

Although the proper toner density of the toners is 5 to 60% by weight, it was set to 30% by weight in this embodiment.

A doctor blade 234 serves to adjust the supply amount of the developer by the developing roller 24 so that the developer will not be supplied excessively or insufficiently to the electrostatic latent image on the photosensitive drum 20. The adjustment is performed by the gap between the edge of the doctor blade 234 and the surfaces of the developing roller 24; the gap is normally adjusted to about 0.1 to 1.0 mm.

The toner hopper 231 is filled only with magnetic toners and has a supply roller 232 inside. The rotation of the supply roller 232 supplies the toners to the developing room 230.

The toners supplied to the developing room 230 are stirred therein and rubbed against the carrier to be charged to a predetermined potential of a given polarity by the developer supplying force of the sleeves of the developing roller 24, the magnetic force of the developing roller 24 and the developer regulating performance of the doctor blade 234. In this embodiment, the toners are charged negatively to control the charging systems of the carrier and the toners.

Further, the gap between the partition member 230-1 and the developing roller 24 at the upstream of the blade 234 is set smaller than the tips of the bristles of the magnetic brush formed on the developing roller 24. In this example, the gap a is set to 2.0 mm as shown in FIG. 6. Accordingly, the magnetic brush on the developing roller 24 is restricted by the partition member 230-1 and receives force by the rotation of the developing roller 24. This increases the stirring of the developer in the developing room 230, ensuring a stable amount of toner charging even within a high toner-density range.

This gap is uniformly set around the developing roller 24, so that the same charging effect will be obtained regardless of the upright position or horizontal position of the printer.

A toner supply passage 235, which is defined by the distal end of the partition member 230-1 and the bottom 230-2, is provided between the toner hopper 231 and the developing room 230. The width b of the toner supply passage 235 is 1.5 mm as apparent from FIG. 6. The toners in the toner hopper 231 are supplied along the toner supply passage 235 to the developing room 230.

The bottom 230-2 that defines the developing room 230 has a projection 230-3 protruding from the toner hopper 231 in the toner supply passage 235. The bottom 230-2 has an inclined face extending upward from the side of the photosensitive drum 20. The gap c between the distal end of the projection 230-2 and the distal end of the partition member 230-1 is set to 1.0 to 1.5 mm as shown in FIG. 6. That is, the bottom 230-2 is inclined by this amount. In addition, the distance d between the distal end of the partition member 230-1 and the developing roller 24 is set to 4.5 to 6.0 mm.

Next, the angles of both walls of the toner cartridge 25 and the toner hopper 231 are set to about 45 degrees with respect to the gravitational direction, ensuring the angle of the toner flow to 45 degrees. Even with the printer set upright, therefore, the toners will be supplied smoothly as will be described later.

The operation of this developing unit will be described below. FIG. 5 shows the state of the developing unit when the printer is set in a horizontal position, with the angles of the walls of the toner cartridge 25 and the toner hopper 231 are set to about 45 degrees with respect to the gravitational direction. Therefore, the toners flow toward the bottom of the toner hopper 231 to be smoothly supplied to the supply roller 232.

In this horizontal position, the toners flow toward the bottom in the toner hopper 231 due to gravitation, so that the supply roller 232 scrapes off the toners at the bottom of the toner hopper 231. At this time, the toners lifted by the supply roller 232 temporarily abut on the partition member 230-1 by the projection 230-3 of the bottom 230-2, and then enter the toner supply passage 235, as shown in FIG. 8A. As a result, only the toners supplied by the toner supply roller 232 enter the toner supply passage 235. The toner abutting portion of the partition 230-1 serves as a buffer so that the force of the toner supply roller 232 will not directly influence the toner supply passage 235. This prevents excessive supply of the toners and allows just the amount of toners needed to be supplied to the developing room 230.

As the bottom 230-2 is tilted with respect to the rotational direction of the developing roller 24 in this case, the magnetic brush of the developing roller 24 after passing the photosensitive drum 20 and the carrier that has escaped the brush will not leak into toner hopper 231 along the toner supply passage 235 through the bottom 230-2. It is therefore possible to prevent the amount of the starter carrier in the developing room 230 from decreasing and accomplish stable image development with the 1.5-component developer.

In the state of the developing unit shown in FIG. 7 with the printer set upright as in FIG. 4, the angles of the walls of the toner cartridge 25 and toner hopper 231 are also set to about 45 degrees. Even in this upright position, therefore, the toners can be smoothly supplied to the toner supply roller 231.

In consideration of the angle of repose, the proper angles of the walls of the toner cartridge 25 and toner hopper 231 would be about 45 degrees ±10 degrees with respect to the gravitational direction in order to feed the toners by the dead weight, and 45 degrees ±5 degrees, preferably, would produce good results.

At this time, the toners stay on the toner hopper side of the partition member 230-1 and will easily fall off the toner supply passage 235 into the developing room 230 as shown in FIG. 7. But, the projection 230-3 of the bottom 230-2 restricts the falling of the toners from the toner supply passage 235 as shown in FIG. 8B so that the toners would hardly drop. In other words, the supply of the toners is dependent on the rotational force of the toner supply roller 232.

As shown in FIG. 8B, the toners pressed by the toner supply roller 232 temporarily abut on the partition member 230-1 by the projection 230-3 of the bottom 230-2, and then enter the toner supply passage 235. As a result, only the toners supplied by the toner supply roller 232 enter the toner supply passage 235. The toner abutting portion of the partition 230-1 serves as a buffer so that the force of the toner supply roller 232 will not directly act to supply the toners. This prevents excessive supply of the toners and allows just the amount of toners needed to be supplied to the developing room 230.

This means that the performance of supplying the toners to the developing room 230 does not change, regardless of whether the printer is set in a horizontal position or in an upright position. Irrespective of whether the printer is set in a horizontal position or in an upright position, therefore, the toner density in the developing room 230 does not change, thus preventing a variation in image density.

With the printer in an upright position, the developer may drop from the developing unit 23. Since the magnetic two-component developer is used, however, the developer is held sticking on the developing rollers by the magnetic force so that the developer hardly drops even when the printer is set upright.

When the magnetic carrier and the magnetic toners are used, particularly, the carrier and toners are both held by the magnet rollers of the developing rollers 24, further preventing the developer from dropping and ensuring stable image development even when the printer is an upright position.

FIG. 9 presents a characteristic diagram showing a change in toner density To when printing is executed first with the printer set in a horizontal position and then with the printer in an upright position.

First, the printer was set in a horizontal position, a predetermined amount of start carrier was placed in the developing room 230 of the developing unit 23 and the developing unit 23 was then activated to conduct printing. The toners are gradually supplied to the developing room 230 from the toner hopper 231, so that as the number of printouts increases, the toner density increases. When the developing room 230 become full with the carrier and toners, the toner density was 30% by weight. Thereafter, even when the number of printouts increased, the toner density did not change.

Under this condition, the printer was then set upright and printing was conducted. The toner density remained the same as that of the previous case of the printer in a horizontal position. When the printer having the structure disclosed in the aforementioned Japanese Unexamined Patent Publication No. 252686/1991 is set upright, the toner density increased as indicated by a while circle. That is, the toner density changed and the image density changed between the horizontal position and the upright position. This proves the stable toner supply of the present invention. Regardless of whether the printer is set in a horizontal or upright position, images will be formed without a variation in image density. The present invention will therefore provide an image forming apparatus which can be set in a horizontal position as well as in an upright position with the same printing quality.

The present invention may be modified in various manners as follows.

First, although a 1.5-component developer having a combination of the magnetic carrier and magnetic toners is used as a developer in the above-described embodiment, the magnetic toners alone may be used as the developer. In this case, the magnetic toners are stirred to be charged by the toner supply roller 232 in the toner hopper 231. Therefore, the toner supply roller 232 becomes an agitator.

Secondly, although only the sleeves of the developing roller 24 are rotated, the magnet roller may also be rotated. Thirdly, although the LED optical system has been explained as an image exposing section, a laser optical system, a liquid crystal shutter optical system, an EL (electroluminescent) optical system and so forth may be used as well.

Fourthly, although the image forming mechanism has been explained as an electrophotographying mechanism in the foregoing description of the embodiment, another image 5 forming mechanism (like an electrostatic recording mechanism) which transfers a toner image on a sheet may also be used, and sheets are not limited to paper but other types of media can be used as well. Further, the photosensitive body is not limited to a drum type, but may be of an endless belt type. Fifthly, although the present invention has been explained as a printing apparatus, it may be a different type of image forming apparatus, such as a copying machine or facsimile.

The present invention is not limited to the above-described embodiment, but may be modified in various forms without departing from the spirit and scope of the invention. Therefore, the present examples and embodiment are to be considered as illustrative and not restrictive and the invention is not to be limited to the details given herein, but may be modified within the scope of the appended claims.

In short, according to the present invention, the developing unit is separated to a developing room and a toner supply room and a toner supply passage for sending only the toners, supplied by the toner supply means, is defined by the partition member. Even with this apparatus set upright, therefore the toner suplement by the toner's falling due to the dead weight will be prevented. As the amount of the toners given by the toner supply means are supplied, the amount of toner supply does not change regardless of whether the apparatus is set in a horizontal position or in an upright position, thus preventing the image density from varying undesirably and allowing a user to freely select the siting position of the apparatus.

What is claimed is:

1. An image forming apparatus, comprising:

a rotary endless latent image carrier;

image forming means for forming an electrostatic latent image on said latent image carrier;

developing means for developing said electrostatic latent image on said latent image carrier, including:

a developing room containing a powdery developer, said developing room including a bottom member which defines a bottom of said developing room;

a developing roller, provided in said developing room and having a cylindrical surface, for supplying said powdery developer to a latent image carrier;

a blade member which regulates a height of the powdery developer on said developing roller;

a toner supply room for containing toners to be supplied to said developing room; and a partition member for partitioning said developing room and said toner supply room and forming a toner supply passage to supply the toners to said developing room, said partition member having an inner surface opposing to the cylindrical surface, the inner surface having an analogous shape as a shape of the cylindrical surface; and transfer means for transferring the developed image on said latent image carrier to a sheet; and wherein a cleanerless process is provided without a cleaner for collecting the residual toner on the latent image carrier, and wherein in the cleanerless process the developing roller collects the residual toner;

wherein the apparatus is capable of performing an image forming operation both in a horizontal position and in an upright position.

2. The image forming apparatus according to claim 1, wherein said bottom member includes a projection which is inclined toward said partition member.

3. The image forming apparatus according to claim 1, wherein said developing unit is located above said latent image carrier when said apparatus is set upright.

4. The image forming apparatus according to claim 1, wherein said toners are magnetic toners, and said developing roller comprises a metal sleeve having a plurality of magnetic poles.

5. The image forming apparatus according to claim 4, wherein said powdery developer is a mixture of a magnetic carrier and magnetic toners.

6. The image forming apparatus according to claim 4, wherein magnetic toners are said powdery developer.

7. The image forming apparatus according to claim 1, wherein said toner hopper is inclined to a gravitational direction so that said toners flow in an inclined direction.

8. The image forming apparatus according to claim 2, wherein said toner hopper is provided with said toner supply means and a toner cartridge, is provided exchangeable with respect to said toner hopper.

9. The image forming apparatus according to claim 2, wherein said developing unit is located above said latent image carrier when said apparatus is set upright.

10. The image forming apparatus according to claim 2, wherein said toners are magnetic toners, and said developing roller comprises a plurality of magnetic poles.

11. A developing apparatus, comprising:

a developing room containing a powdery developer, said developing room including a bottom member which defines a bottom of said developing room;

a developing roller, provided in said developing room and having a cylindrical surface, for supplying said powdery developer to a latent image carrier;

a blade member which regulates a height of the powdery developer on said developing roller;

a toner supply room for containing toners to be supplied to said developing room; and a partition member for partitioning said developing room and said toner supply room and forming a toner supply passage to supply the toners to said developing room, said partition member having an inner surface opposing to the cylindrical surface, the inner surface having an analogous shape as a shape of the cylindrical surface; and wherein a cleanerless process is provided without a cleaner for collecting the residual toner on the latent image carrier and wherein in the cleanerless process, the developing roller collects the residual toner;

wherein the apparatus is capable of performing an image forming operation both in a horizontal position and in an upright position.

12. The image forming apparatus according to claim 11, wherein said projection is inclined toward said partition member.

13. The image forming apparatus according to claim 11, wherein said developing unit is located above said latent image carrier when said apparatus is set upright.

14. The image forming apparatus according to claim 11 wherein said toners are magnetic toners, and said developing roller comprises a metal sleeve having a plurality of magnetic poles.

15. The image forming apparatus according to claim 14, wherein said powdery developer is a mixture of a magnetic carrier and magnetic toners.

16. The image forming apparatus according to claim 14, wherein magnetic toners are said powdery developer.

17. The image forming apparatus according to claim 11, wherein said toner hopper is inclined to a gravitational direction so that said toners flow in an inclined direction.

18. The image forming apparatus according to claim 12, wherein said toner hopper is provided with said toner supply means and a toner cartridge, is provided exchangeable with respect to said toner hopper.

19. The image forming apparatus according to claim 12, wherein said developing unit is located above said latent image carrier when said apparatus is set upright.

20. The image forming apparatus according to claim 12, wherein said toners are magnetic toners, and said developing roller comprises a plurality of magnetic poles.

* * * * *

UNITED STATES PATENT AND TRADEMARK OFFICE

CERTIFICATE OF CORRECTION

PATENT NO.: 5,572,298
DATED : November 5, 1996
INVENTOR(S): NAGAHARA et al

It is certified that error appears in the above-identified patent and that said Letters Patent is hereby corrected as shown below:

On the Title Page, item [30], the Foreign Application Priority Data number has been transposed, delete "5-098573" and add --5-098537--

Signed and Sealed this

Twenty-second Day of April, 1997

Bruce Lehman

*Attest:*

BRUCE LEHMAN

*Commissioner of Patents and Trademarks*

*Attesting Officer*